US006766747B1

(12) United States Patent
Wolfe

(10) Patent No.: US 6,766,747 B1
(45) Date of Patent: Jul. 27, 2004

(54) GAME TABLE WITH RECESSED GAME BOARD STORAGE AREA

(76) Inventor: John P. Wolfe, 5457 E. Capri Ave., Mesa, AZ (US) 85206

( * ) Notice: Subject to any disclaimer, the term of this patent is extended or adjusted under 35 U.S.C. 154(b) by 0 days.

(21) Appl. No.: 10/445,774

(22) Filed: May 27, 2003

(51) Int. Cl.[7] ..... A47B 85/00
(52) U.S. Cl. ..... 108/26; 108/63; 108/84
(58) Field of Search ..... 108/63, 72, 84, 108/85, 86, 179, 25, 26; 312/24, 27, 208.5, 272, 272.5, 25

(56) References Cited

U.S. PATENT DOCUMENTS

| | | | | | |
|---|---|---|---|---|---|
| 22,464 | A | * | 12/1858 | Uhlinger | 312/25 |
| 532,074 | A | * | 1/1895 | Kundtz | 312/25 |
| 716,435 | A | | 12/1902 | Lackner | |
| 2,102,449 | A | * | 12/1937 | Zimmerman | 108/63 |
| 2,292,016 | A | | 8/1942 | Scovil | |
| 3,563,624 | A | | 2/1971 | Stice | |
| 3,880,429 | A | | 4/1975 | Blumenaus | |
| 4,161,234 | A | * | 7/1979 | Munn | 186/52 |
| 4,494,466 | A | | 1/1985 | Synek | |
| 4,967,925 | A | | 11/1990 | Feniello | |
| 5,078,461 | A | * | 1/1992 | Beck et al. | 312/331 |
| 5,240,315 | A | * | 8/1993 | Roberts et al. | 312/27 |
| 5,360,264 | A | | 11/1994 | Crane | |
| 5,490,675 | A | | 2/1996 | Persidsky | |
| 5,503,400 | A | | 4/1996 | Silva | |

FOREIGN PATENT DOCUMENTS

| | | | | |
|---|---|---|---|---|
| CH | 119425 | * | 3/1927 | 312/25 |
| CH | 186803 | * | 11/1935 | |

* cited by examiner

*Primary Examiner*—Jose V. Chen

(57) ABSTRACT

A game table includes a storage area with a center leaf horizontally mounted in the storage area. When the top cover is in a closed position, the center leaf is positioned at the bottom of the storage area. A pulley system is used to raise the center leaf into a playing position when the top cover is moved to the open position. When the top cover is closed again, the pulley system lowers the center leaf into the storage area. A game board and game pieces positioned on the center leaf are maintained in the same position when the top cover is closed and the center leaf is lowered into the storage area. By maintaining the center leaf in a horizontal position, persons playing a game can suspend the game and safely keep the game pieces in the same position by merely closing the top cover. The game may be resumed by opening the top cover to raise the center leaf back into the playing position.

20 Claims, 8 Drawing Sheets

GAME TABLE WITH RECESSED GAME BOARD STORAGE AREA

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to a game board table with a recessed storage area for storing a game board on a center leaf of the table. More particularly, embodiments of the present invention provide for a table having a center leaf with a pulley system connected to pivotable table top cover. When the top cover is opened and closed, the pulley system raises and lowers the center leaf, and any game board positioned on the center leaf, within a storage area formed in the center of the table. By maintaining the center leaf in a horizontal position, the game board and game pieces on the game board can temporarily be stored without disturbing the game pieces such that the game may be resumed at a later time.

BACKGROUND OF THE INVENTION

Game boards for games such as chess, checkers, and backgammon are typically played on game boards which are laid flat on a supporting table surface. Tables may be designed specifically for games and recreational purposes, and such tables often include a game board painted on the surface of the table. Other game tables may include a game board integrally formed in the surface of the table by inlays into the permanent structure of the table.

The game board and the pieces for playing the game are typically stored in a game box or other storage container. To start the game, the board is placed on a table and the pieces are located on the game board in their appropriate starting positions. The game pieces are moved about the board during the playing of the game. When the game is completed, the pieces are removed from the board and returned to their storage container.

For game tables where the game board is integrally formed in the surface of the table, the game pieces are still generally stored either in a separate game box or in storage drawer formed in the table. The game pieces are removed from the storage drawer for playing of the game, and then returned to the storage drawer when the game is completed.

A feature which is not generally available with existing game boards and game tables is the ability to store game pieces on a game board for an extended period of time without disturbing the pieces. On occasion, individuals may start a game of chess, but they may not be able to complete the game in one setting. The players often desire to continue the game at a later time. The game board and/or game table must be kept in a safe place where the pieces on the game board will not be disturbed. If there is no place to temporarily store the game board with the game pieces in their position on the board when the game was suspended, then the players are forced to make a written record of the location of the game pieces before storing the game pieces. In order to continue the game at a later time, the pieces must be individually positioned in the proper location based on the written record. Often the players will just abandon the partially completed game if they are forced to move the pieces and the game board to their normal storage position in a game box.

Most players will not have a convenient place to store the game board without disturbing the game pieces. In homes with children and/or pets, it is even more difficult to find a space to store the game board without returning the game pieces to their typical storage location. In most cases when a game is suspended for a period of time, there is a high probability that the game pieces may accidentally be disturbed or otherwise moved from their position on the board when the game was halted.

Jig-saw puzzles are another table activity for which temporary storage is a problem. People working on jig-saw puzzles often work on puzzles over an extended period of time. Frequently, a partially assembled puzzle must be left on the table for extended periods of time while the puzzle is being completed. Many jig-saw puzzle players would welcome a game table which provides the capability of safely storing a partially completed puzzle.

The play of board games, such as Monopoly (registered trademark of Hasbro, Inc.), may also be temporarily suspended by the players during the middle of a game. Players could participate in a marathon game of Monopoly over an extended period of time if there was a safe and convenient means for storing the game board without disturbing the game pieces. For any game which requires an extended period of time to complete, there are often problems in temporarily suspending the game for completion at a later time because there is no convenient place to temporarily store the game in progress.

U.S. Pat. No. 4,494,466 discloses a table with a mechanism for varying the size of a table top. A center leaf is selectively positioned between a pair of side leaves. The center leaf is stored in a vertical position when not in use. The table top game container disclosed in U.S. Pat. No. 4,967,925 has storage areas for storing game pieces when the table is not in use. U.S. Pat. Nos. 5,360,264 and 3,563,624 describe tables with storage areas which can be configured in various different structures. The tables also include storage compartments for storing games and toys. None of these patens discloses a table which permits the temporary storage of game pieces on the game board when a game is in progress.

Other patents related to game tables and the storage of games pieces include U.S. Pat. Nos. 5,503,400; 5,490,675; 3,880,429; 2,292,016; and 716,435.

In general, game players often have a need for an attractive game table which includes a convenient storage area for storing the game board and the game pieces in playing position when a game is temporarily suspended. Games which require an extended period of time to complete, such as chess and jig-saw puzzles, would be ideally suited for a game table having a storage area for storing a game in progress.

SUMMARY OF THE INVENTION

An embodiment of the invention is a game table with a recessed storage area to store a game board and game pieces in playing position. The game table includes a center leaf which is used to support a game board. Alternatively, the game board could be integrally formed in the center leaf. A pulley system attached to the top cover of the game table is used to selectively raise and lower the center leaf within the storage area.

The storage area is an open-top rectangular box mounted in the frame of a table. The storage box is sized to permit the center leaf to be maintained in a horizontal position with sufficient depth to move the horizontal center leaf from a storage position at the bottom of the storage box to a playing position at the top of the storage box.

The game table includes a movable top cover to cover the storage box when the cover is in the closed position. The cover is connected to the table frame by hinges such that the cover is pivoted from the closed position to an open position to permit access to the storage area. In addition, the game table is provided with a pulley system having pulley wheels on the bottom of the center leaf. Pulley wires run from one section of the top cover through the pulley wheels under the center leaf and to the other section of the top cover. When the movable top cover is pivoted to the open position, the pulley system raises the center leaf to the top of the storage box. When the top cover is closed, the center leaf is returned towards the bottom of the storage area. The center leaf is maintained in a horizontal position such that the game pieces are not disturbed when the center leaf is raised or lowered in the storage box.

When the center leaf is at the bottom of the storage area, spacer bars are positioned to support and stabilize the center leaf. When the center leaf is at the top of the storage area, the center leaf engages the frame to steady the center leaf. Each pulley wire includes a spring segment which provides tension to keep the center leaf firmly engaged with the top frame.

The top cover will typically include four movable segments. The outer two segments are hinged to the frame and pivot open such that the surface of the outer segments are coplanar with the table frame when the top cover is in the open position. The two center segments are connected by hinges to the outer segments. When the top cover is fully opened, the center segments pivot under the outer segments to engage the side of the table frame. This provides additional support to stabilize the cover when the center leaf is positioned at the top of the storage area.

When a game is played, the game board is positioned on the center leaf. If the game is suspended in mid-game, then the top cover can be closed to lower the center leaf into the storage area without disturbing the game pieces on the game board. When the game players desire to resume the game, the top is opened to raise the center leaf and game board to the playing position. The game pieces will be located on the game board in the same position as when the game was suspended.

These as well as other aspects and advantages of the present invention will become apparent to those of ordinary skill in the art by reading the following detailed description, with appropriate reference to the accompanying drawings.

DETAILED DESCRIPTION OF THE PREFERRED EMBODIMENTS

Figure 1:
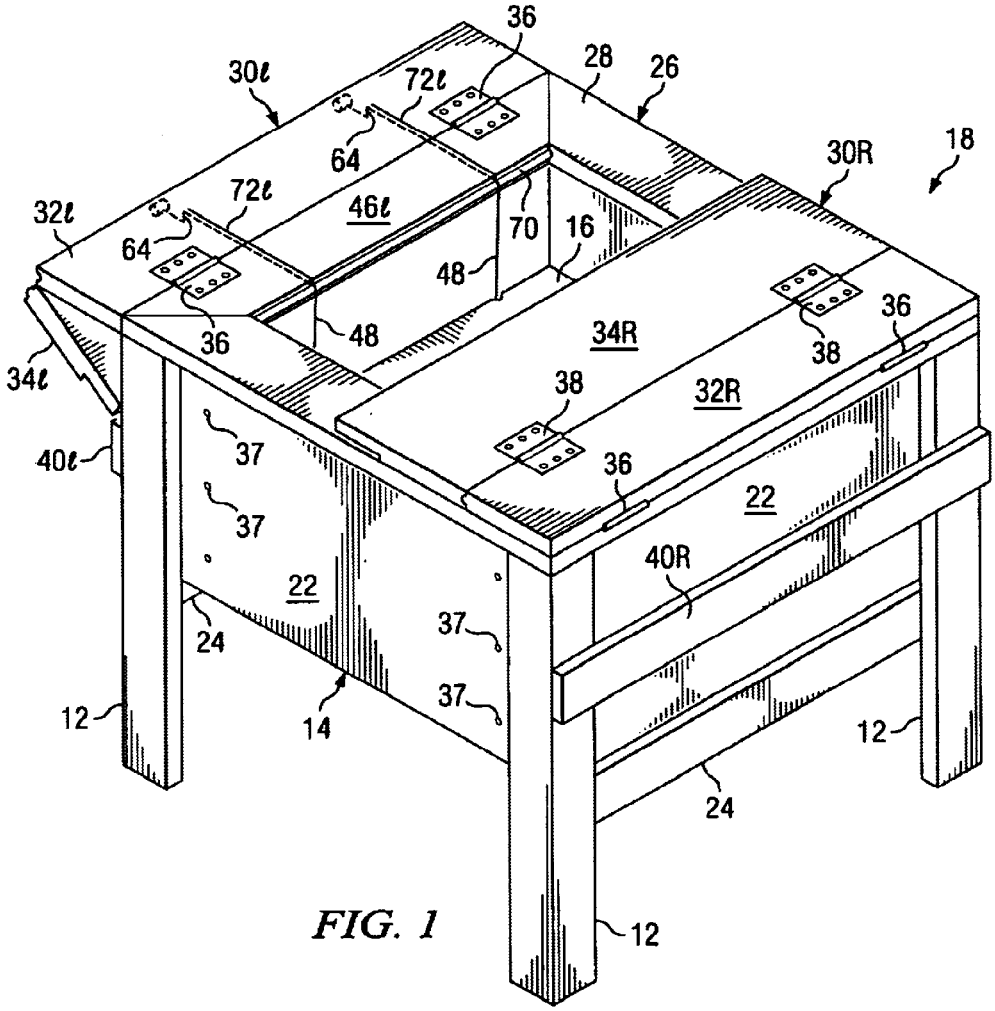
FIG. 1 is a perspective view of the game table showing the right section of the top cover in a closed position and the left section in an open position, and showing the center leaf in the storage area.

Referring now to FIG. 1, the game table 10 of the present invention includes four legs 12, a storage box 14 which forms a storage area for horizontally storing the center leaf 16, and a top cover 18 for selectively covering the storage open top of the storage box 14. When the top cover 18 is in a closed position, the center leaf 16 is positioned towards the bottom of the storage box 14. When the top cover 18 is moved to an open position, the center leaf 16 is maintained in a horizontal position and is raised up to the top of the storage box 14 to form a surface for supporting a game board for playing a game.

The legs 12 may be any style, such as L-shaped, rectangular, or round. The legs are may be made of any material which is used to build tables and other furniture, such as wood, metal, or plastic, and may be stained or painted to any desired color. The height of the legs 12 are selected so that the top cover 18 is at an appropriate table height for playing a game. There are a number of other configurations which could be used to support the storage box 14 and top cover 18. Instead of positioning the legs 12 on the corner of the storage box 14, the legs could be secured to the storage box at the middle of the side panels. An alternative embodiment could have a center pedestal secured to the bottom of the storage box 14 instead of four corner legs.

The height of the game table 10 may be provided at any convenient height. The table 10 may have a height of a typical card table or end table of 26 to 32 inches. At such a height, chairs could be positioned about the table 10 for playing games. The table 10 could also be configured at a lower height, similar to a coffee table. In such a shorter configuration, the storage box 14 would have to be sized accordingly. Dimensions of the top cover 18 could also be set at any convenient dimensions.

The storage box 14 includes a bottom 20 and four sides 22 having an open top which is selectively covered by the top cover 18. Two inner support members 24 are used to secure and support the bottom 20. The two support members 24 are secured on the inside of the legs 12 and extend in parallel between the legs 12 along the side of the table 10. Alternatively, the bottom 20 of the storage box 14 may be secured directly to the legs 12 using brackets or other fastening means. The inner support members 24 are secured to the legs 12 at an appropriate height in the middle of the legs based on the size of the storage box 14. The depth of the storage box 14 is sized to provide the desired storage area. A depth of twelve inches or less would be sufficient for most games to be stored in the storage box 14.

A rectangular frame 26 is secured to the tops of the legs 12. The frame 26 includes a center aperture which is aligned with the open top of the storage box 14. The aperture of the frame 26 is smaller than the open top of the storage box 14. The aperture of the frame 26 is typically square or rectangular in shape because most games boards and puzzles are square or rectangular in shape, but the aperture could also have an oval or other configurations. The size of the game table 10, and the corresponding size of the storage box 14 and the frame 26 can be manufactured to different sizes. The preferred size of the storage box 14 and frame 26 would provide an aperture of approximately two feet by two feet, which would accommodate a standard size chess board. Larger sizes could be used to provide larger apertures for use with jig-saw puzzles or other game boards.

The frame 26 includes a top frame surface 28 which supports the top cover 18 when the top cover 18 is closed. When the top cover 18 is open, the top frame surface 28 provides an exposed surface. The top frame surface 28 can be used for temporarily supporting game pieces, snacks, drinks or other items typically placed on a table when playing a game or puzzle. The tope frame surface 28 will be a finished surface since it will be used when playing games. The surface 28 may also be covered with felt or other similar game table finish.

The top cover 18 is divided into at least two sections (30R, 30L), and each of the sections 30R, 30L may further be divided into an outer segment 32R, 32L and center segment 34R, 34L such that the top cover 18 can be pivoted from a closed position to an open position. For the four segment top cover, the outer segment 32R has one edge connected by recessed hinges 36 to an outer edge of the frame 26 and the other edge connected by recessed hinges 38 to the edge of the center segment 34R. The other outer segment 32L is similarly connected by hinges 36 to the outer edge of the frame 26 opposite from the outer segment 32R. The center segments 34R, 34L are connected by hinges 38 to their respective outer segments 32R, 32L. When the top cover is in the closed position, the edges of the two center segments 34R, 34L are adjacent each other to cover the aperture of frame 26 and the top opening of the storage box 14. Hinges 36, 38 may be butler type hinges or other similar hinges that have a relatively flat profile.

When the top cover 18 includes the four segments 32R, 32L, 34R, 34L, the left section 30L is moved from a closed position to an open position by pivoting the outer segment 32L approximately 180 degrees so that the outer segment 32L is coplanar with the frame 26. As part of the process of opening the left section 30L, the center section 34L is further pivoted approximately 135 degrees until the edge of center section 34L engages the top surface of support member 40L. The outer segment 32R and center segment 34R of the other top cover section 30R are similarly pivoted to engage the top surface on top support member 40R. In this configuration when the center segments 34R, 34L are pivoted to engage the top support members 40R, 40L, the center segments 34R, 34L must be wider than the outer segments 32R, 32L in order for the outer segments to be coplanar with the frame 26. The depth of the support members 40R, 40L must be great enough to provide a surface for supporting the center segments 34R, 34L. The preferred depth would be 0.625 inches or greater. For a typical game table to be used with a chess board, the width of the top cover can be set at 22 inches with the center segments 34R, 34L being 6.0 inches and the outer segments 32R, 32L being 5.0 inches. The center segments 34R, 34L are typically 8–20 percent wider than the outer segments 32R, 32L. Other dimensions would also be acceptable for the table top cover 18 and the top cover segments.

Figure 2:
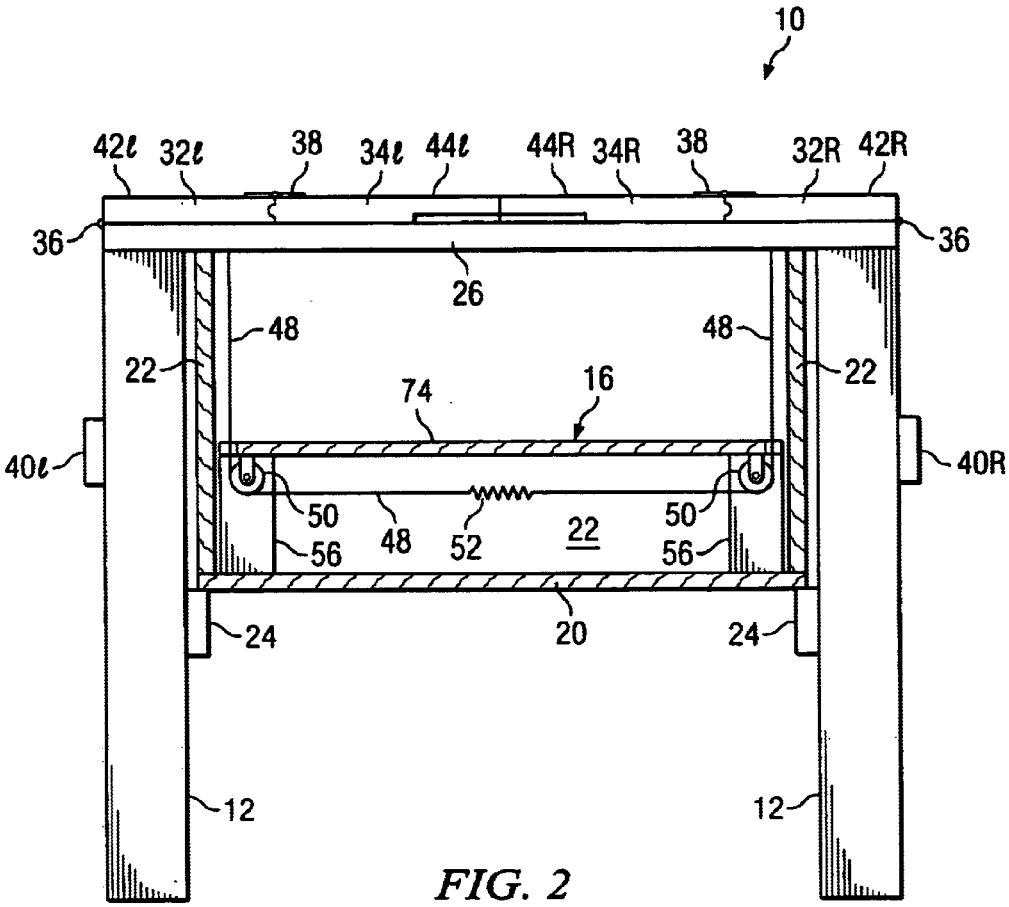
FIG. 2 is a front elevational view of the game table with the top cover in a fully closed position, and with the storage box only being shown in a front cross-sectional view to provide a view of the center leaf, pulleys, the pulley wire, and the spacer bars.
Figure 8:
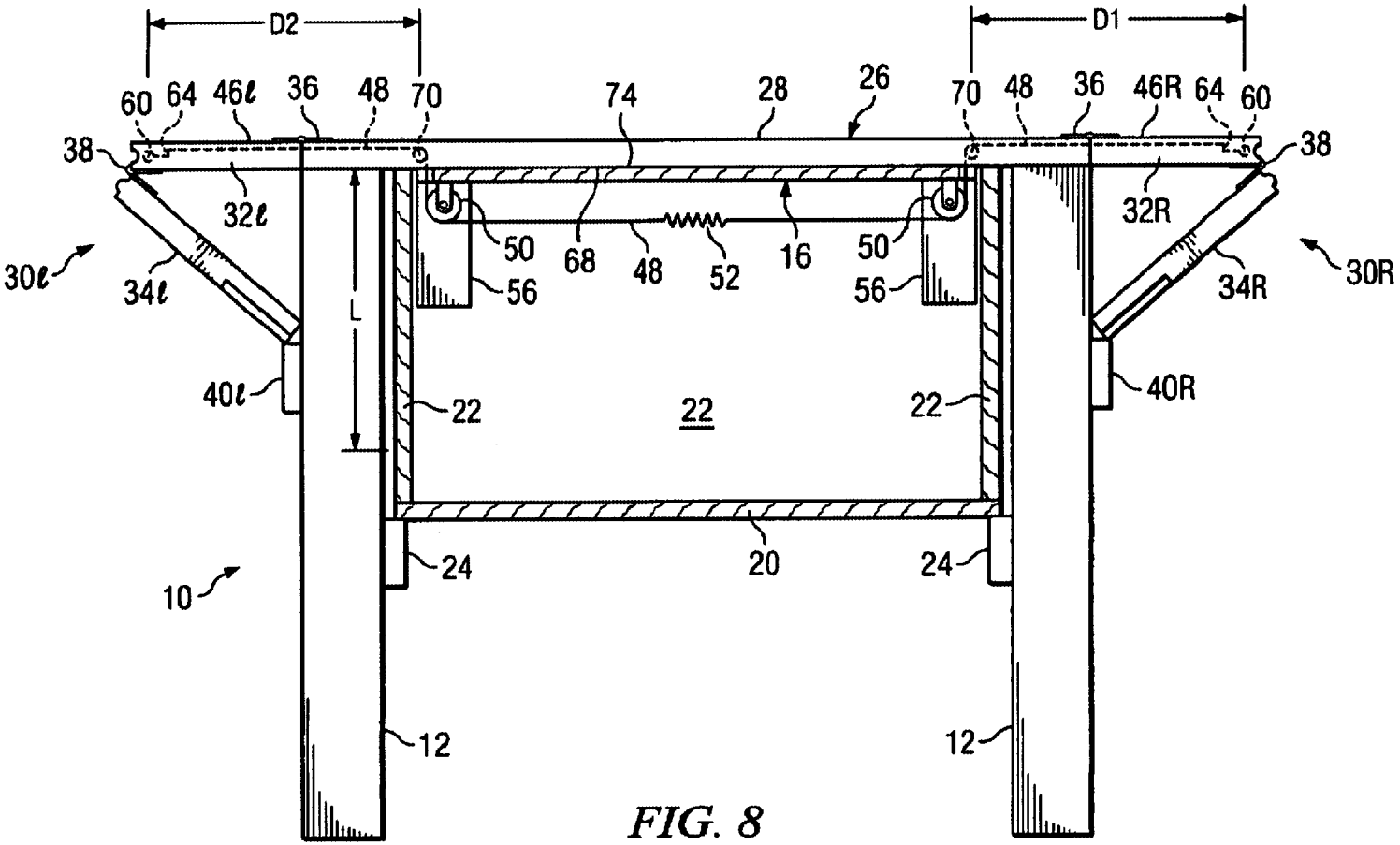
FIG. 8 is a front elevational view of the game table with both the left section and the right section of the top cover in the open position, and with the storage box only being shown in a front cross-sectional view to provide a view of the center leaf; the pulleys, the pulley wire, and the spacer bars, with the center leaf being in position for playing a game.

When the top cover 18 is in a closed position as shown in FIG. 2, the top surfaces 42R, 42L of the outer segments 32R, 32L and the top surfaces 44R, 44L of the center segments 34R, 34L form a table top surface which can be used for a variety of purposes similar to a regular table or end table. When the top cover 18 is in the open position as shown in FIG. 8, the game surface 46R, 46L is approximately coplanar with the top surface 28 of the frame 26. A locking device (not shown) may be used to selectively lock the top cover 18 in a closed position. The locking device could be positioned on the center segments 34R, 34L to prevent the segments from being pivoted to the open position.

Instead of providing two segments to each of the top cover sections 30R, 30L and pivoting the center segments 34R, 34L to be supported by the top support members 40R, 40L, alternatively the top cover sections could each be made from a single piece (not shown in drawings). In the open position of the top cover 18, the unitary top cover sections would be rotated a full 270 degrees so that the top cover sections are generally perpendicular to the floor when in the open position. When the unitary top cover sections are in the open position, a substantial load would be placed on the hinges 36. In addition, this open position would not provide the additional game surface in the horizontal plane. By using a double set of hinges 36, 38 with two segments for each section 30R, 30L of the top cover 18, the center segments 34R, 34L can be positioned on the top support segments 40R, 40L to support the top cover sections 30R, 30L in the open position.

Figure 5:
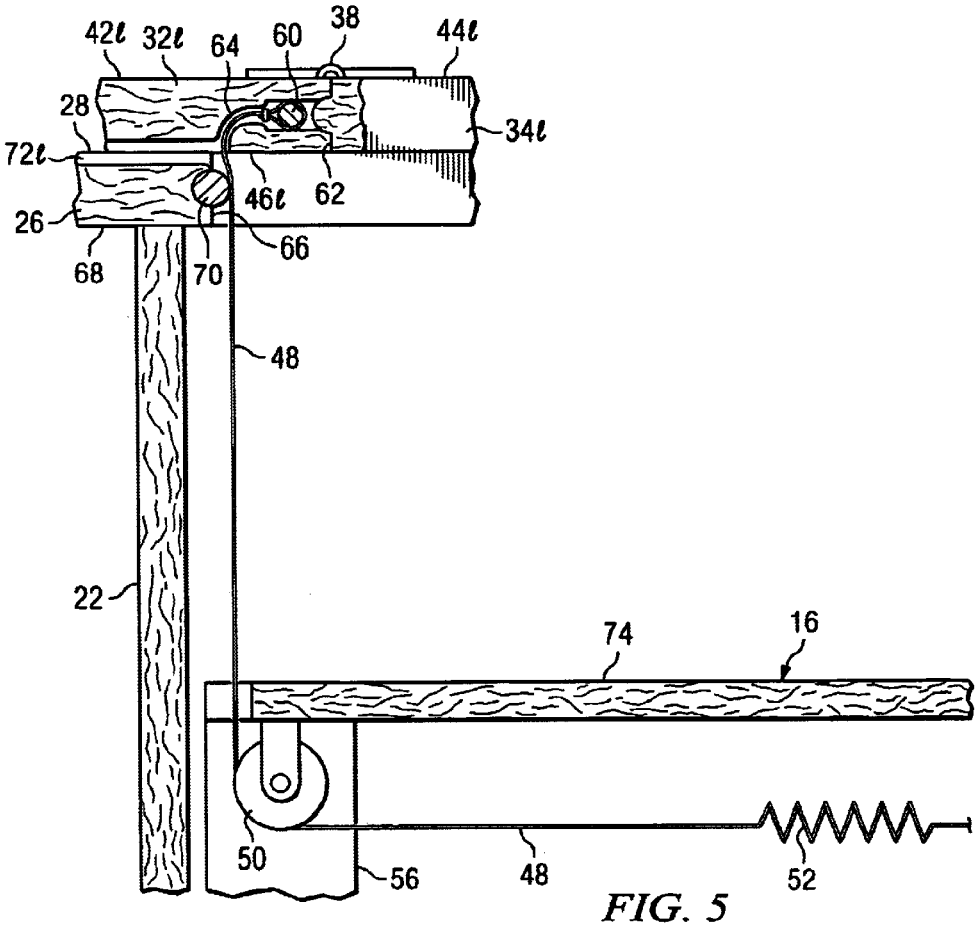
FIG. 5 is an enlarged, front fragmental, cross-sectional view of the center leaf and the left section of the top cover of the game table in a closed position, and showing the positioning of the pulley in the outer segment of the left section of the top cover.

FIG. 2 and FIG. 5 provide a view of the center leaf 18 with a pulley system extending from the left outer segment 32L around the bottom of the center leaf 16 and back up to the right outer segment 32R. A pulley wire 48 is attached to left outer segment 32L and extends around a pulley 50 attached to the bottom of the center leaf 16. Another pulley 50 is attached to the bottom of the center leaf 16 such that the pulleys are positioned at opposite edges of the center leaf 16. The pulley wire 48 extends underneath the center leaf 16 between the pulleys 50 and then is attached to the right outer segment 32R. The pulley wire 18 may be a steel or aluminum cable rated for supporting the center leaf 16 and any additional anticipated weight to be placed on the center leaf. A 60 pound rating for the pulley wire 48 provides more than adequate strength for most applications. A tension spring 52 is spliced into the pulley wire 48 by crimping the pulley wire to the two ends of the tension spring. 52. The size and strength of the tension spring 52 may also be selected based on the anticipated weight to be supported by the center leaf 16.

The center leaf 16 may be supported by a single pulley wire 48 and one pair of pulleys 50 positioned towards the center of the center leaf 16. Additional pulley wires 48 and pairs of pulleys 50 could be added to provide additional stability to the center leaf 16. Two pulley wires 48 in spaced-apart relationship and two corresponding pairs of pulleys 50 is the preferred configuration. Such configuration provides adequate stability when raising and lowering the center leaf 16. Additional pulley wires 48 and pulleys 50 add cost to the table 10 without any significant improvement in operation.

Figure 3:
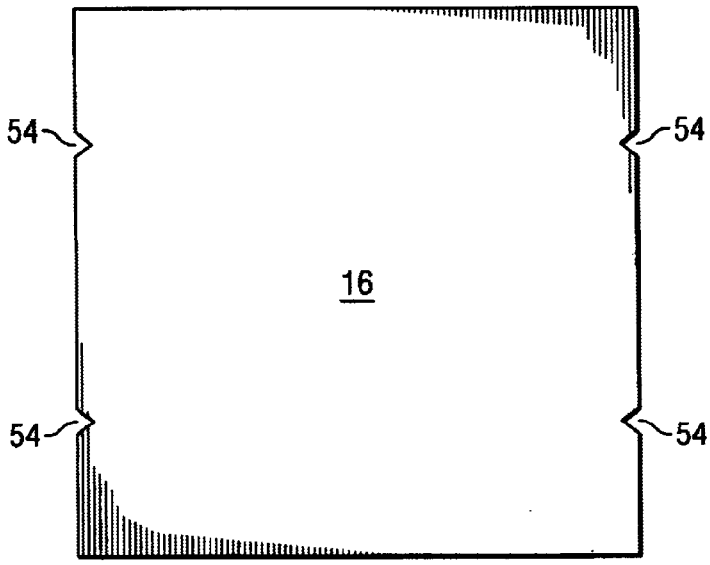
FIG. 3 is a top plan view of the center leaf.

In order to improve stability and prevent the center leaf 16 from swaying or being tipped at an angle, the size of the center leaf 16 is sized to fit the size of the storage area in the storage box 14 when the center leaf 16 is in a horizontal position. The edges of the center leaf 16 are in close proximity with the sides 22, and with just enough spacing provided between the sides 22 of the storage box 14 and the edges of the center leaf 16 to permit the center leaf 16 to freely move up and down in the storage box 14. In order to keep the pulley wires 48 in proper alignment and to provide space for the pulley wires 48 to move up and down without being pinched between the edge of the center leaf 16 and the sides 22, a notch 54 is formed in the edge of the center leaf (FIG. 3).

In order to gain access to the bottom of the storage box 14 between the center leaf 16 and the bottom 20, one of the side panels can be secured by screws 37 to the other sides and bottom of the storage box 14. The screws 37 can be unscrewed and the side temporarily removed in order to provide access to the storage box 14. Alternatively, one or more access doors (not shown) could be provided in the bottom 20 or in the lower portion of the sides 22. The access doors would permit the servicing of the pulleys 50 and the tension spring 52. The access doors would also facilitate the retrieval of any game pieces or puzzle pieces which accidentally slip between the edge of the center leaf 16 and the side 22 of the storage box 14.

Figure 4:
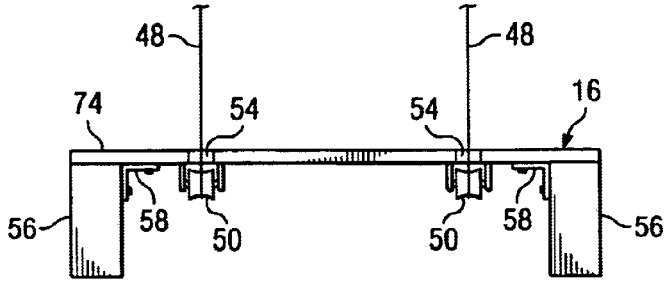
FIG. 4 is an enlarged side view of the center leaf of the game table showing the pulley system and the spacer bars.

When the top cover 18 is closed as shown in FIG. 2, the center leaf 16 is positioned toward the bottom 20 of the storage box 14. Since the pulleys 50 and the pulley wire 48 are positioned on the bottom of the center leaf 16, it is preferable to keep the pulley system from engaging the bottom 20 of the storage box 14. As shown in FIG. 4, one or more spacer bars 56 are attached to the bottom of the center leaf 16 by brackets 58 or other similar fasteners. Securing a spacer bar 56 in the four corners of the center leaf 16 provides additional stability when the center leaf is lowered in the storage box 14 as the top cover 18 is closed. The spacer bars 56 may be made of any material, such as plastic, wood, or metal.

FIG. 5 provides a more detailed view of the pulley wire 48 extending from the outer segment 32L down to the pulley 50 on the center leaf 16. When the outer segment 32L is in the closed position, the pulley wire 48 extends from the game surface 46L such that pulley wire 48 is positioned approximately perpendicular to the center leaf 16 and parallel to the side 22. The pulley wire may be attached directly to the game surface 46L by a staple or other fastening mechanism. In order to keep the game surface 46L free of the fasteners, the pulley wire 48 may be secured by an anchor 60 positioned in a counter sink in the end groove portion 62 of the outer segment 32L. The pulley wire 48 is wrapped around the anchor 60 and crimped to secure the end of the pulley wire 48. Feed holes 64 are drilled in the outer segments 32R, 32L to feed the wire from the anchors 60 to the game surface of the outer segments 32R, 32L. As noted above, the position of the feed holes 64 is selected to that the pulley wire 48 is positioned approximately perpendicular to the center leaf 16 and parallel to the side 22 positioned when the outer segments 32R, 32L are closed. The anchor 60 may be a short segment of a steel rod positioned in the counter sink.

After the pulley wire 48 exits the outer segment 32L, the pulley wire 48 is directed through a frame groove 66 extending from the top surface 28 of frame 26 through to the bottom edge surface 68 of the frame 26. A fixed bearing rod 70 is inserted into the frame 26 to facilitate the movement of the pulley wire 48 when the outer segment 32L is moved between an open and a closed position. The fixed bearing rod 70 engages the pulley wire 48 as the outer segment 32L is opened, and this prevents the pulley wire from wearing down the edge of the frame 26. The fixed bearing rod 70 may be a single rod or a plurality of rod segments positioned in the frame groove 66. The fixed bearing rod 70 may be, for example, a steel rod having a diameter between 0.875 and 0.25 inches. A groove 72L is cut in the top surface 28 of the frame 26 and in the game surface 46 of the outer segment 32L so that the pulley wire 48 can be maintained in a recessed position when the top cover section 30L is opened.

Figures 6, 7:
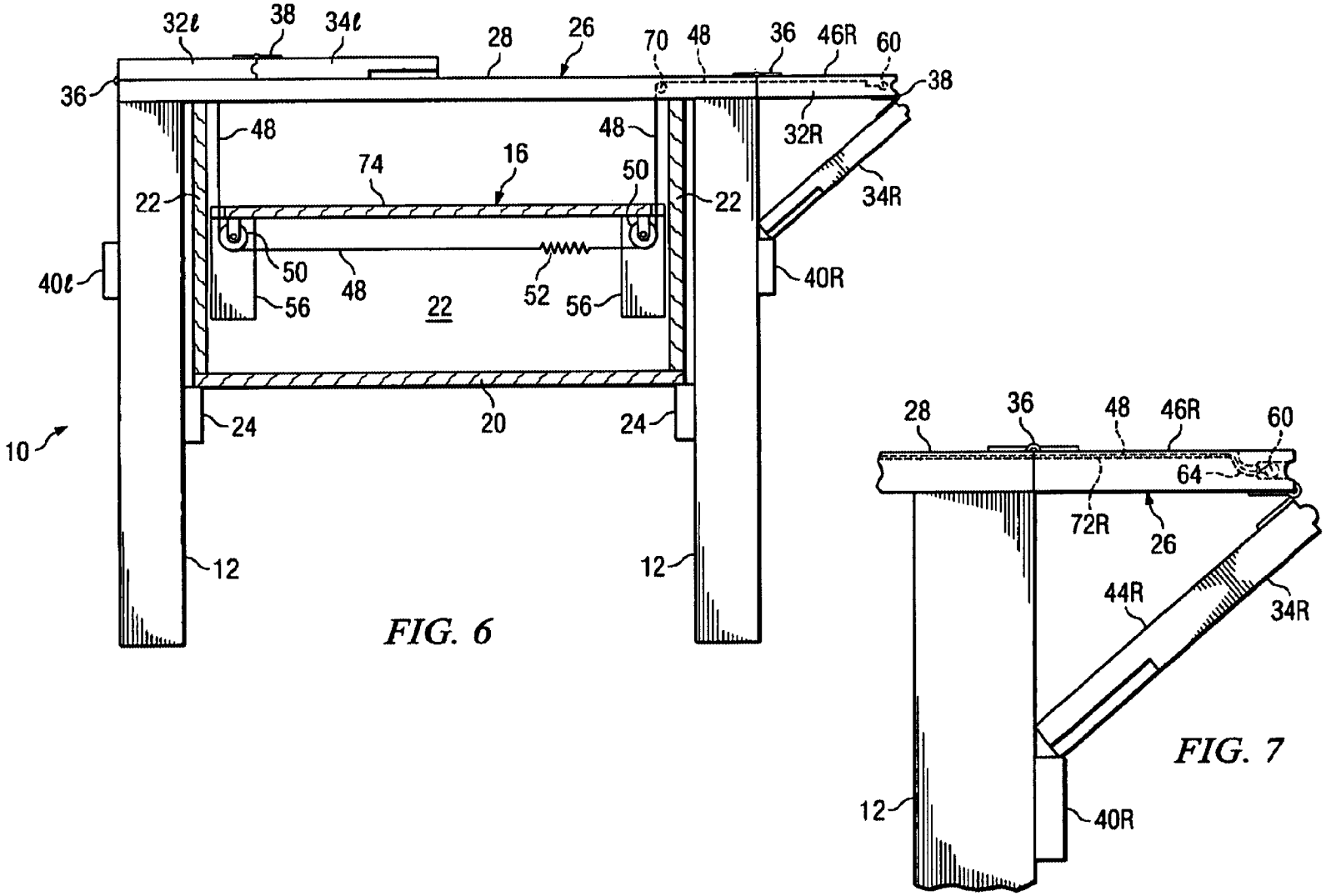
FIG. 6 is a front elevational view of the game table with the left section of the top the cover in a closed position and the right section of the top cover in an open position, and with the storage box only being shown in a front cross-sectional view to provide a view of the center leaf; the pulleys, the pulley wire, and the spacer bars.
FIG. 7 is an enlarged, fragmental, cross-sectional view of the right section of the top cover in an open position.

FIG. 6 shows the table 10 with the left top cover section 30L still in the closed position and the right top cover section 30R in the open position. When the right top cover section 30R is moved from a closed to an open position, the pulley wire 48 is pulled to the right and the center leaf 16 moves approximately half way up the storage box 14 towards the frame 26 of the table 10. The tension sprint 52 moves to the right side with the open cover section 30R. A groove 72R is also cut in the right side of the top surface 28 of the frame 26, and in the game surface 46 of the outer segment 32R, so that the pulley wire 48 can be maintained in a recessed position when the top cover section 30R is opened. If the pulley wires 48 were permitted to rest on the top surface 28 and game surface 46, the pulley wire 48 might interfere with the playing of the games. The grooves 72R, 72L alleviate this problem.

The top cover sections 30R, 30L may be opened or closed in any sequence. When the top cover section 30R is opened as shown in FIGS. 6–7, the center segment 34R is pivoted on hinges 38 until it is position to engage the top support 40R. This configuration helps support the outer segment 32R in the open position.

Figure 9:
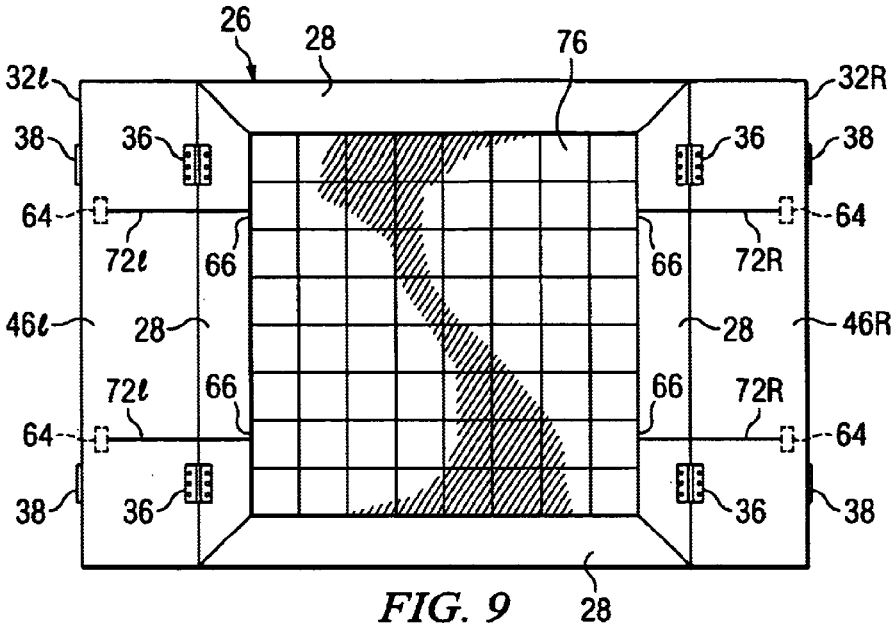
FIG. 9 is a top plan view of the game table with the top cover in the open position and the center leaf positioned for playing a game, the center leaf including an integrally formed game board pattern for playing chess or checkers.

FIGS. 8–9 show the table 10 in the open configuration with the center leaf 16 in position for playing a game. Both top cover sections 30R, 30L are in the open position. The outer segments 32R, 32L are pivoted 180 degrees on hinges 36 to provide additional playing surface 46R, 46L. The center segments 34R, 34L are pivoted on hinges 38 to engage top supports 40R, 40L. Other configurations could be used for the top cover sections 30R, 30L and for the support mechanisms. The top cover sections could be formed from a single piece instead of the two segments shown in the drawings. A one-piece top cover section could be rotated 180 degrees to form additional playing surface or 270 degrees to extend along the side of the table perpendicular to the floor. If a one-piece top cover section is extended 180 degrees, one or two support legs (not shown in drawings) could be extended from the bottom of, the top cover section to the floor to provide support.

When both top cover sections 30R, 30L are in the open position, the pulley wires 48 cause the center leaf 16 to be moved to the top of the storage box 14 such that the edges of the center leaf 16 engage the bottom surface 68 of the frame 26. The center leaf 16 and rectangular frame 26 are sized such that the center leaf 16 is larger than the opening in the frame 26. The tension spring 52 is positioned approximately in the middle of the center leaf 16. The length of the pulley wire 48 is selected so that the tension spring 52 is under tension. This exerts an upward force on the center leaf 16 such that the center leaf 16 firmly engages the bottom surface 68 of frame 26. Even when a game board and game pieces are placed on the center leaf 16, there is sufficient tension on the spring 52 to prevent the center leaf from bouncing or slipping into the storage box 14.

When the top cover sections 30R, 30L are open, the top surface 28 of frame 26 and the game surface 46R, 46L of the outer segments 32R, 32L are generally co-planar. The center leaf 16 is slightly recessed from the top surface 28 of the frame 26, the depth of the recess being equal to the thickness of the frame 26. The top surface 74 of the center leaf 16 provides a playing surface for playing games.

The size of the center leaf 16 and the corresponding size of the aperture of the frame 26 are sized to accommodate playing boards, such as a square chess board or a Monopoly board. A rectangular shaped center leaf 16 could be used for accommodating jig-saw puzzles or other larger games. The top surface 28, game surfaces 46R, 46L and top surface 74 can be finished wood surfaces. Felt or other similar coverings could also be attached to these surfaces for playing games.

The center leaf 16 may include a game board 76 integrally formed on the top surface, such as the chess board shown in FIG. 9. The game board 76 may be painted or stained into the top surface 74.

Figure 10:
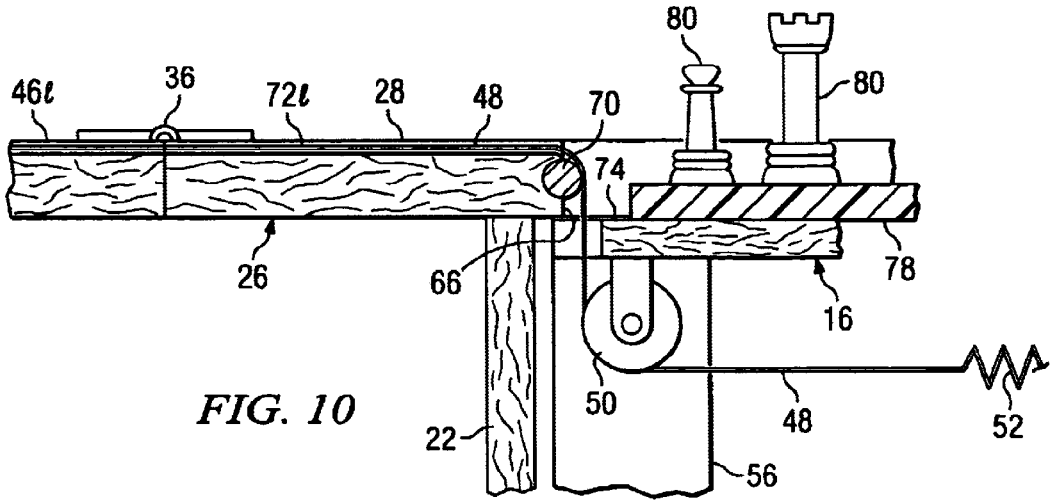
FIG. 10 is an enlarged, front fragmental, cross-sectional view showing the positioning of the center leaf against the frame, and the positioning of the pulley wire in the recessed groove of the frame, when the top cover is in the full open position.

The grooves 72R, 72L in the frame 26 and the outer segments 32R, 32L are aligned with the pulley wire 48 and anchor 60 so that the pulley wire 48 may be positioned in the grooves 72R, 72L when the top cover 18 is fully open. FIG. 10 shows the pulley wire 48 positioned in the groove 72L.

When the top cover sections 30R, 30L are fully open, a free standing game board 78 may be positioned on top surface 74 of center leaf 16, as shown in FIG. 10. Chess players 80 are positioned on the game board 78 for playing the game. Any type of game board may be positioned on the top surface 74 of the center leaf 16. Playing cards, jig-saw puzzles, Monopoly, and other types of games may also be played on the center leaf 16.

If the players of a game desire to store the game pieces in a specific position on the game board 78 or directly on the center leaf 16, the table 10 of the present invention is able to move from an open position to a closed position without having to move the game board 78 or the pieces 80 on the game board 78. Players may desire to temporarily store the game board 78 and game pieces 80 during the middle of a game in order to resume the game at a later time. The players may also desire to store the pieces 80 in a position for starting a new game.

Figure 11:
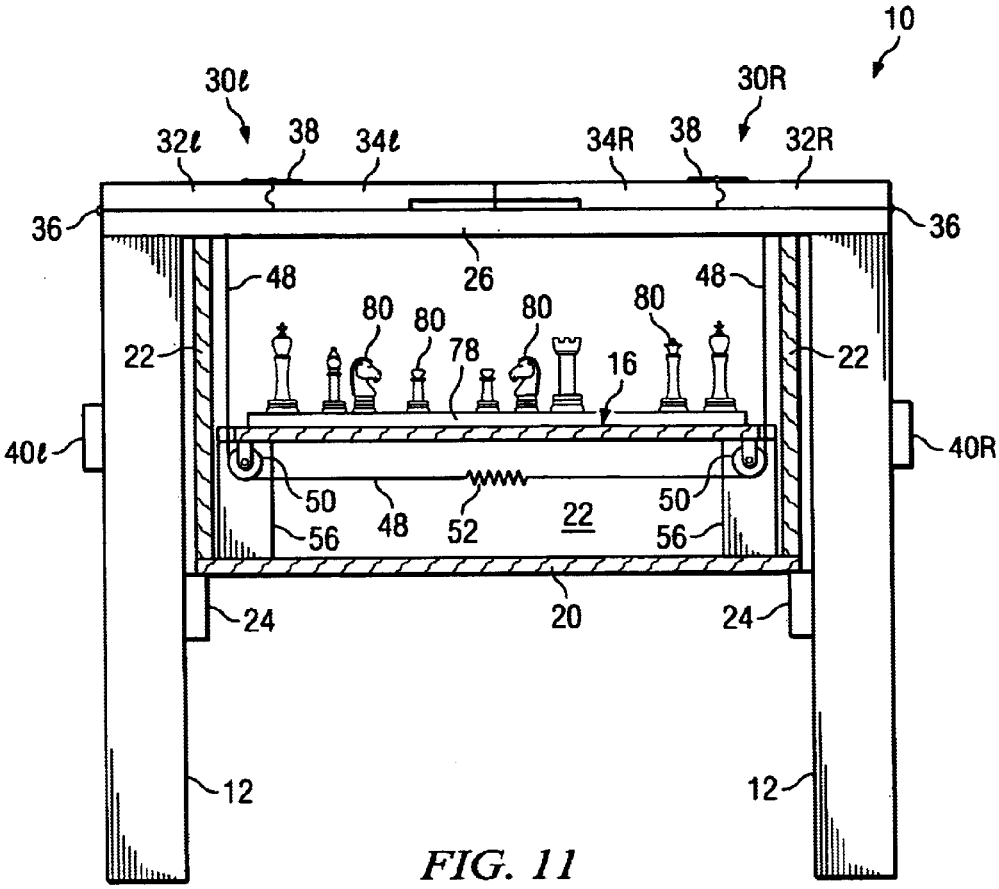
FIG. 11 is a front elevational view of the game table with the top cover in a fully closed position, and with the storage box only being shown in a front cross-sectional view to provide a view of the center leaf; the pulleys, the pulley wire, and the spacer bars, the center leaf including a game board and playing pieces for storing a game in progress.

When the game table 10 as shown in FIG. 8 is in the open position, players are able to set up a game and begin to play. If the players want to temporarily store a game in progress, the top cover is moved from the open to the closed position. To move the game into the storage box 14, the center segments 34R, 34L and the outer segments 32R, 32L are pivoted back into the closed position as shown in FIG. 11. The pulley wires 48 and pulleys 50 provide for the lowering of the center leaf 16 into the storage box. The game board 78 is maintained in a horizontal position such that the game pieces 80 are not disturbed when the center leaf 16 is lowered into the storage box 14. When the game table 10 is in the closed position, the top cover sections 30R, 30L form a table top which encloses the storage box 14. When the players desire to resume the game, the top cover sections 30R, 30L are moved to the open position and the center leaf is raised by the pulleys 50 and pulley wires 48 into the playing position at the top of the storage box 14.

FIG. 8 also shows the relationship between the overall lift of the center leaf 16 in the storage box 14 and the mounting of the pulley wire 48 on the outer segments 32R, 32L. The lift distance L is less than the length of the pulley wire is moved, which is the distance between the feed holes 64 on the two outer segments 32R, 32L and the fixed bearing rod 70, such distance being designated as D1 and D2 in FIG. 8. When the right outer segment is pivoted, the lift distance is D1 and the center leaf 16 is moved more than half way from its storage position to the top of the storage box 14. When the left outer segment 32L is pivoted to an open position, the center leaf 16 is lifted the balance of the lift distance L until the center leaf 16 engages the bottom surface 68 of the frame 26. Because D1 plus D2 is greater than the lift distance L, the additional distance moved by the pulley wire puts tension on the spring 52. This ensures that the center leaf 16 is firmly engaged against the frame 26. The spring 52 is sized to accommodate the tension placed on the spring when both the right and left sections 30R, 30L are in the open position.

Figure 12:
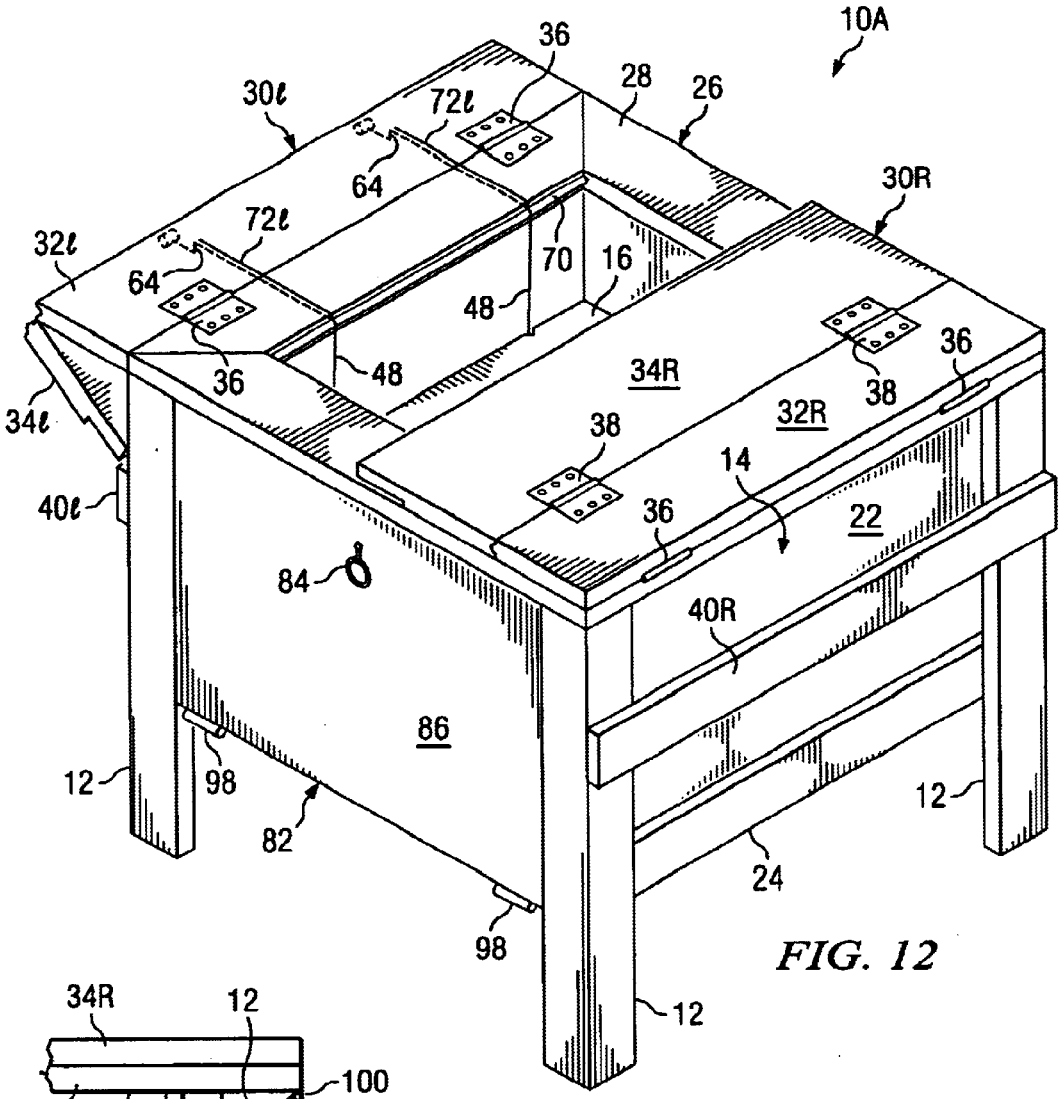
FIG. 12 is a perspective view of an alternative embodiment of the game table showing an additional storage drawer positioned between two legs at the front of the game table.
Figure 13:
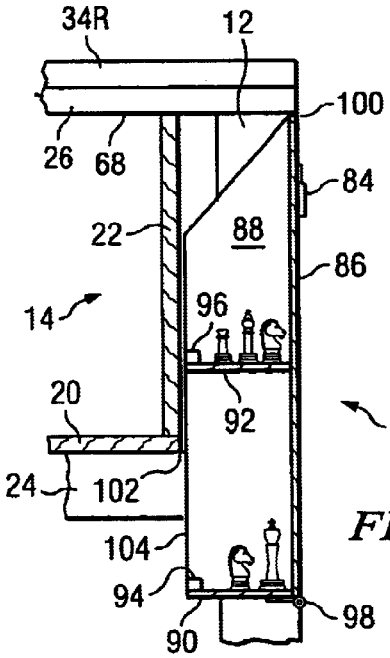
FIG. 13 is a fragmental, cross-sectional side view of the additional storage drawer mounted by hinges to a leg of the table, and showing the front side of the storage box.

FIG. 12 shows the game table 10A with a storage drawer 82 added to the front of the game table 10A. A second, similar storage drawer could be added to the back of the game table 10A. The storage drawer 82 can be used to store game pieces, cards, pencils, paper, and other accessories for playing various games. Except for the structural elements related to the storage drawer 82, all of the other elements of table 10A are identical to the elements shown for table 10 in FIG. 1; therefore the same reference numbers are used for the common elements.

A handle 84 is used to pull the drawer 82 open and push the storage drawer 82 close. The storage drawer 82 includes a front panel 86, two side panels 88, a bottom shelf 90, and a top shelf 92. The depth of the side panels 88 is selected so that the front side 22 of the storage box 14 engages the side panels 88 or is in close proximity to the side panels 88. The front side 22 acts as a back panel for storage drawer 82. A lip 94 is formed on the edge bottom shelf 90 and a similar lip 96 is formed on the top shelf 92. The lips 94, 96 help to retain game pieces and other items stored on the shelves 90, 92.

A pair of hinges 98 is used to connect the storage drawer 82 to the legs 12 of table 10A. In order to permit the storage drawer 82 to open, the hinges 98 are positioned on the legs 12 below the bottom 20 of the storage box 14. The height of the front panel 86 and the side panels 88 is selected so that the top edge 100 of the front panel 86 of the storage drawer 82 is in proximity to the bottom surface 68 of frame 26. The storage drawer 82 can be pivoted on hinges 98 until the edges 104 of the side panels 88 come in contact with the corner edge 102 of the storage box 14. The storage drawer 82 is opened a sufficient distance to permit access to the shelves 92, 94 for storing items.

Figure 14:
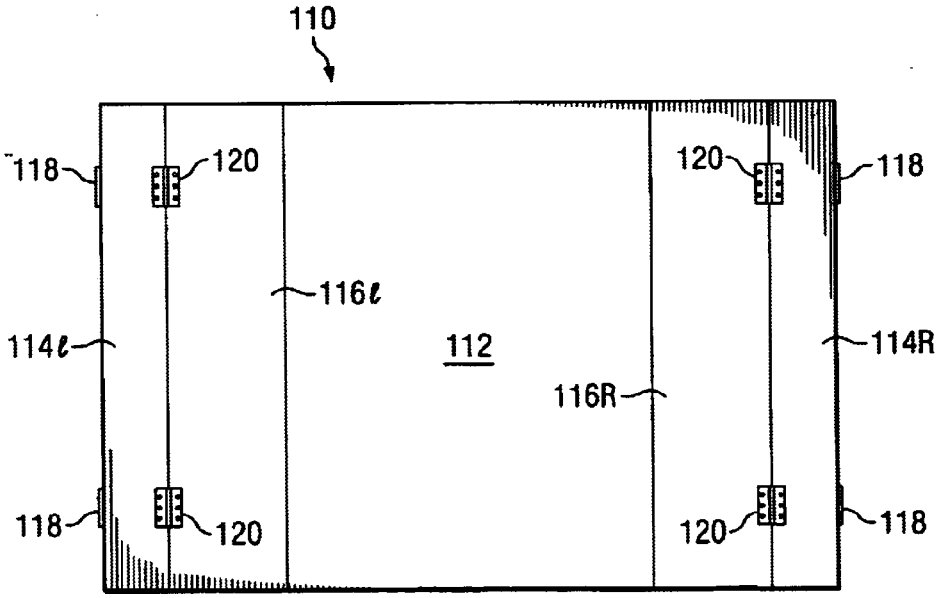
FIG. 14 is a top plan view of a game table showing the top cover in a closed position and having a removable section positioned between the hingedly connected sections.

As the size of the table increases to accommodate a larger center leaf and a corresponding larger top opening of the storage box, the pivoting actions of the segments of the top cover may become more problematic. FIG. 14 shows a top view of an alternative configuration for the top cover to alleviate any problems in pivoting large segments. On table 110, a removable section 112 is positioned between the pivotable segments 114R, 114L, 116R, 116L. The pivotable segments are secured by hinges 118 and hinges 120, and are pivoted between the closed position and an open position in the same manner as described for table 10. The center leaf is raised and lowered in the same manner by a pulley system. The segments 114R, 114L, 116R, 116L must have sufficient size to provide the desired lift of the center leaf. Since the depth of the storage box is approximately the same for any size table, the pivotable segments do not have to increase in size.

The removable section 112 is secured between the center sections 116R, 116L when the top cover is in the closed position. The removable section 112, since it is not permanently connected to the table 110, is lifted up and set aside when the top cover of table 110 is moved to an open position. To return to the closed position, the removable section 112 is placed between the center sections 116R, 116L. Latches or other known fastening mechanisms may be used to secure the removable section 112 in the closed position.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

What is claimed is:

1. A game table having a recessed area for storage of a movable table leaf which is used as a playing surface, said game table comprising:

a mounting frame having an open center area, said mounting frame including a rectangular top surface having an aperture for providing access to open center area, and said mounting frame including a plurality of vertical legs extending from a lower side of the top surface to form the open center area;

a generally rectangular enclosure having a storage area, said enclosure positioned in the center area and attached to said mounting frame, and said enclosure having a bottom, four sides, and an open top aligned with the aperture in said mounting frame;

a top cover having a first movable rectangular section and a second moveable rectangular section positioned on the top surface of said mounting frame to selectively cover the storage area of said rectangular enclosure, each rectangular section having a fixed edge hingedly connected to the top surface on opposite sides of the mounting frame such that each rectangular section can be pivoted approximately 180 degrees from a closed position covering storage area of the rectangular enclosure to an open position;

a movable table leaf positioned in said rectangular enclosure; and a pulley system mounted on said enclosure, said pulley system including a pulley wire having a tension spring formed in said pulley wire, and extending from the first movable section of the top cover to a pair of pulleys secured at opposite edges on a bottom side of the movable table leaf, and then to the second section of the top cover, whereby the movable table leaf is maintained in a horizontal orientation and is selectively moved from a storage position towards the bottom of the rectangular enclosure to a playing position at the open top of the rectangular enclosure when the top cover is pivotably moved from the closed position to the open position.

2. The game table defined in claim 1, wherein a game board is integrally formed in said movable table leaf.

3. The game table defined in claim 1, wherein said pulley system includes, in addition to the first pulley wire, a second pulley wire having a tension spring formed in said second pulley wire, and extending from the first movable section of the top cover to a pair of pulleys secured at opposite edges on the bottom side of the movable table leaf, and then to the second section of the top cover, said first pulley wire and said second pulley wire being in spaced apart relationship.

4. The game table defined in claim 1, including a storage drawer mounted on an external surface of the mounting frame.

5. A game table having a recessed area for storage of a movable table leaf which is used as a playing surface, said game table comprising:

a mounting frame having an open center area, said mounting frame including a rectangular top surface having an aperture for providing access to open center area, and said mounting frame including a plurality of vertical legs extending from a lower side of the top surface to form the open center area;

a generally rectangular enclosure having a storage area, said enclosure positioned in the center area and attached to said mounting frame, and said enclosure having a bottom, four sides, and an open top aligned with the aperture in said mounting frame;

a top cover having a first movable rectangular section and a second moveable rectangular section positioned on the top surface of said mounting frame to selectively cover the storage area of said rectangular enclosure, wherein the first movable section of the top cover includes an outer segment having a fixed edge hingedly connected to the top surface of the mounting frame and an opposite movable edge hingedly connect to a first center segment, and the second movable section of the top cover includes an outer segment having a fixed edge hingedly connected to an opposite side of the top surface of the mounting frame and an opposite movable edge hingedly connected to a second center segment, whereby the center segments are in proximity to each other when the top cover is in a closed position, and whereby each outer segment can be pivoted approximately 180 degrees from a closed position to an open position, and whereby the center sections engage opposite sides of said mounting frame when the top cover is in an open position;

a movable table leaf positioned in said rectangular enclosure; and a pulley system mounted on said enclosure, said pulley system including a pulley wire extending from the outer segment of the first movable section of the top cover to under the movable table leaf, and then to the outer segment of the second section of the top cover, whereby the movable table leaf is selectively moved from a storage position towards the bottom of the rectangular enclosure to a playing position at the open top of the rectangular enclosure when the top cover is pivotably moved from the closed position to the open position.

6. The game table defined in claim 5, wherein the pulley system includes two pulleys mounted on a bottom side of said movable table leaf along opposite edges of said movable table leaf for engaging the pulley wire.

7. The game table defined in claim 5, wherein said pulley system includes, in addition to the first pulley wire, a second pulley wire extending from the outer segment of the first movable section of the top cover to under the movable table leaf, and then to the outer segment of the second section of the top cover, said first pulley wire and said second pulley wire being in spaced apart relationship.

8. The game table defined in claim 7, wherein the pulley system includes two pulleys mounted on a bottom side of said movable table leaf along opposite edges of said movable table leaf for engaging the first pulley wire, and two additional pulleys mounted on a bottom side of said movable table leaf along opposite edges of said movable table leaf for engaging the second pulley wire.

9. The game table defined in claim 7, wherein an end of the first pulley wire and an end of the second pulley wire are connected to the movable edge of the outer segment of the first movable section, an end of the first pulley wire and an end of the second pulley wire are connected to the movable edge of the outer segment of the second movable section of the top cover.

10. The game table defined in claim 5, wherein the outer segments of the movable sections of the top cover are hingedly connected to the top surface of the mounting frame such that when the outer segments are pivoted by approximately 180 degrees, the outer segments of the first and second movable sections form a coplanar surface with the top surface of said mounting frame when the top cover is in the open position.

11. The game table defined in claim 10, wherein grooves are formed in the outer segments of the first and second movable sections and the top surface of said mounting frame for receiving the pulley wire when the top cover is in an open position.

12. A game table having a recessed area for storage of a movable table leaf which is used as a playing surface, said game table comprising:

a mounting frame having an open center area, said mounting frame including a rectangular top surface having an aperture for providing access to open center area, and said mounting frame including a plurality of vertical legs extending from a lower side of the top surface to form the open center area;

a generally rectangular enclosure having a storage area, said enclosure positioned in the center area and attached to said mounting frame, and said enclosure having a bottom, four sides, and an open top aligned with the aperture in said mounting frame;

a top cover having a first movable rectangular section and a second moveable rectangular section positioned on the top surface of said mounting frame to selectively cover the storage area of said rectangular enclosure, each rectangular section having a fixed edge hingedly connected to the top surface on opposite sides of the mounting frame such that each rectangular section can be pivoted approximately 180 degrees from a closed position covering storage area of the rectangular enclosure to an open position;

a movable table leaf positioned in said rectangular enclosure; and a pulley system mounted on said enclosure, said pulley system including a first pulley wire and a second pulley wire in spaced apart relationship, said first pulley wire and said second pulley wire each extending from the first movable section of the top cover to a pair of pulleys secured to a bottom side of the movable table leaf, and then to the second section of the top cover, whereby the movable table leaf is maintained in a horizontal orientation and is selectively moved from a storage position towards the bottom of the rectangular enclosure to a playing position at the open top of the rectangular enclosure when the top cover is pivotably moved from the closed position to the open position.

13. The game table defined in claim 12, wherein the pulley wires of said pulley system includes a tension spring insert in series in each pulley wire, said tension spring being positioned under the bottom of the movable table leaf.

14. The game table defined in claim 12, wherein said pulley system includes a fixed bearing component mounted in the mounting frame adjacent the aperture such that said fixed bearing component slidingly engages said pulley wires.

15. The game table defined in claim 12, including spacer bars attached to the bottom of said movable table leaf for engaging the bottom of said enclosure when the top cover is in the closed position.

16. The game table defined in claim 12, wherein the first movable section of the top cover includes an outer segment having a fixed edge hingedly connected to the top surface of the mounting frame and an opposite movable edge hingedly connect to a first center segment, and the second movable section of the top cover includes an outer segment having a fixed edge hingedly connected to an opposite side of the top surface of the mounting frame and an opposite movable edge hingedly connected to a second center segment, whereby the center segments are in proximity to each other when the top cover is in a closed position, and whereby each outer segment can be pivoted approximately 180 degrees from a closed position to an open position, and whereby the center sections engage opposite sides of said mounting frame when the top cover is in an open position.

17. The game table defined in claim 16, wherein the outer segments of the movable sections of the top cover are hingedly connected to the top surface of the mounting frame such that when the outer segments are pivoted by approximately 180 degrees, the outer segments of the first and second movable sections form a coplanar surface with the top surface of said mounting frame when the top cover is in the open position.

18. The game table defined in claim 17, wherein grooves are formed in the outer segments of the first and second movable sections and the top surface of said mounting frame for receiving the pulley wire when the top cover is in an open position.

19. The game table defined in claim 16, wherein an end of the first pulley wire and an end of the second pulley wire are connected to the movable edge of the outer segment of the first movable section, an end of the first pulley wire and an end of the second pulley wire are connected to the movable edge of the outer segment of the second movable section of the top cover.

20. The game table defined in claim 12, wherein said top cover includes a removable section selectively positioned between the first movable rectangular section and the second moveable rectangular section positioned on the top surface of said mounting frame to selectively cover the storage area of said rectangular enclosure, wherein the first movable section of the top cover includes an outer segment having a fixed edge hingedly connected to the top surface of the mounting frame and an opposite movable edge hingedly connect to a first center segment, and the second movable section of the top cover includes an outer segment having a fixed edge hingedly connected to an opposite side of the top surface of the mounting frame and an opposite movable edge hingedly connected to a second center segment, whereby the removable section is positioned over the storage area and the center segments are in proximity to opposite edges of the removable section when the top cover is in a closed position, and whereby each outer segment can be pivoted approximately 180 degrees from a closed position to an open position, and whereby the center sections engage opposite sides of said mounting frame and the removable section can be temporarily removed when the top cover is in an open position.

* * * * *